US010894309B2

(12) United States Patent
Niemioja

(10) Patent No.: US 10,894,309 B2
(45) Date of Patent: Jan. 19, 2021

(54) SEALING ARRANGEMENT OF TOOL AND METHOD OF SEALING

(71) Applicant: SANDVIK MINING AND CONSTRUCTION OY, Tampere (FI)

(72) Inventor: Ossi Niemioja, Kallioloa (FI)

(73) Assignee: SANDVIK MINING AND CONSTRUCTION OY, Tampere (FI)

( * ) Notice: Subject to any disclaimer, the term of this patent is extended or adjusted under 35 U.S.C. 154(b) by 193 days.

(21) Appl. No.: 16/104,934

(22) Filed: Aug. 19, 2018

(65) Prior Publication Data

US 2019/0054607 A1 Feb. 21, 2019

(30) Foreign Application Priority Data

Aug. 21, 2017 (EP) ..... 17187042

(51) Int. Cl.
*B25D 17/00* (2006.01)
*E02F 3/96* (2006.01)
*B25D 17/26* (2006.01)

(52) U.S. Cl.
CPC ..... *B25D 17/00* (2013.01); *E02F 3/966* (2013.01); *B25D 17/26* (2013.01); *B25D 2217/0069* (2013.01); *B25D 2250/121* (2013.01); *B25D 2250/365* (2013.01)

(58) Field of Classification Search
CPC ..... B25D 17/00; B25D 17/26; B25D 2217/0069; B25D 2250/121; B25D 2250/365; B25D 2250/331; B25D 2250/005; B25D 17/06; B25D 17/08; B25D 17/245; B25D 17/265; B25D 9/00; B25D 9/14; B25D 9/18; B25D 9/26; E02F 3/966; F16B 37/00; F16B 37/041; F16B 37/122; F16B 5/02; F16B 2037/007; F16K 31/12; F16K 47/04; F16J 15/545; F16J 15/3208; F16J 15/3244; F16J 15/324; E21B 4/06; E21B 4/14; E21B 21/08; E21B 21/103; B25C 1/00; B25C 1/08
USPC ..... 173/1
See application file for complete search history.

(56) References Cited

U.S. PATENT DOCUMENTS 2,846,247 A * 8/1958 Davis ..... E21B 33/085 277/328
4,529,210 A * 7/1985 Biffle ..... E21B 33/085 166/387
5,199,833 A * 4/1993 Fehrle ..... B23Q 3/12 279/19.3
5,873,579 A 2/1999 Prokop
(Continued)

FOREIGN PATENT DOCUMENTS

DE 8615170 U1 * 8/1986
DE 8615170 U1 8/1986
(Continued)

*Primary Examiner* — Anna K Kinsaul
*Assistant Examiner* — Chinyere J Rushing-Tucker
(74) *Attorney, Agent, or Firm* — Corinne R. Gorski

(57) ABSTRACT

A seal for a tool of a breaking hammer, a sealing arrangement, a breaking hammer and a method of sealing a tool of breaking hammer is provided. The seal includes a resilient first seal element and a rigid second seal element. The first seal element is fastened to a seal housing and the second seal element is fastened to the first seal element. The second seal element provides mechanical protection for the first seal element.

10 Claims, 7 Drawing Sheets

(56) References Cited

U.S. PATENT DOCUMENTS

| | | | | |
|---|---|---|---|---|
| 7,198,098 | B2 * | 4/2007 | Williams | E21B 33/085 166/84.3 |
| 7,712,746 | B2 * | 5/2010 | Manschitz | B23B 31/107 279/143 |
| 7,832,495 | B2 * | 11/2010 | Pillers, II | B25D 17/08 173/1 |
| 7,926,593 | B2 * | 4/2011 | Bailey | E21B 21/001 175/87 |
| 8,496,073 | B2 * | 7/2013 | Eisenhardt | B25F 5/006 173/162.1 |
| 2008/0105462 | A1 * | 5/2008 | May | E21B 33/085 175/7 |
| 2012/0037389 | A1 * | 2/2012 | Jagdale | B25D 17/20 173/90 |
| 2014/0353915 | A1 * | 12/2014 | Jordan | F16J 15/3208 277/309 |
| 2016/0123472 | A1 * | 5/2016 | Kahra | B25D 17/00 299/100 |
| 2018/0305892 | A1 * | 10/2018 | Robson | B28D 1/26 |

FOREIGN PATENT DOCUMENTS

| | | | |
|---|---|---|---|
| EP | 2589842 | A1 | 5/2013 |
| KR | 100864563 | B1 | 10/2008 |

* cited by examiner

SEALING ARRANGEMENT OF TOOL AND METHOD OF SEALING

RELATED APPLICATION DATA

This application claims priority under 35 U.S.C. § 119 to EP Patent Application No. 17187042.1, filed on Aug. 21, 2017, which the entirety thereof is incorporated herein by reference.

TECHNICAL FIELD

The present disclosure relates to a seal of a tool of a breaking hammer. The seal is a sleeve-like piece. An inner periphery of the seal serves as a sealing surface against the tool and an outer periphery is provided with fastening surfaces for fastening the seal to a body of the breaking hammer. The disclosure further relates to a sealing arrangement, a breaking hammer and a method of sealing a tool of a breaking hammer.

BACKGROUND

Breaking hammers are used to break hard materials, such as rock, concrete, and the like. The breaking hammer includes a percussion device for generating impact pulses to a breaking tool connectable to the breaking hammer. The tool is sealed to a body of the breaking hammer or other surrounding structure by means of a tool sealing, which is typically a ring or sleeve shaped sealing element.

The current sealing arrangements have shown to contain some disadvantages relating to their wear resistance and complex structure, for example.

SUMMARY

An object of the invention is to provide a novel and improved seal of a tool. A further object is to provide a novel and improved sealing arrangement, breaking hammer and method of sealing a tool, which all aim to decrease wearing of a seal of a tool.

An idea of the disclosed solution is that the seal has a two-part and sleeve-like configuration. The seal includes a first seal element and a second seal element which are arranged successively in axial direction. An outer periphery of the first seal element is provided with fastening surfaces for fastening the seal to a sealing housing or corresponding structure surrounding the seal. However, the second seal element is fastened only to the first seal element. In other words, between the second seal element and the body structure of the breaking hammer there is no direct fastening. Further, the first seal element is made of resilient material and includes a first tool opening which is intended to be in resilient contacting relationship with the tool. The second seal element is made of different material than the first seal element. The second seal element is a rigid element comprising a second tool opening, which is dimensioned to form a sealing clearance between the tool and the second seal element. When the seal is mounted, the resilient first seal element of the seal allows the rigid second seal element to move transversally together with the tool relative to the sealing housing.

An advantage of the disclosed solution is that the structure of the seal is simple and durable. Further, the seal has good sealing properties since it has two successive sealing components. The structure of the seal is also compact and it is easy to mount and dismount. Further, the seal does not require special support arrangements and complicated structures for assembling it. An additional benefit may be that the disclosed seal may be changed without use of any special tools and even at work site.

Furthermore, when the seal operates properly and prevents impurities from entering inside the structure of the breaking hammer, the operating life of the breaking hammer may be longer. Similarly, the seal may prevent lubricating grease from leaking out of the breaking hammer, whereby life time of the tool may be longer. In conclusion, the disclosed solution may allow longer life time for the seal itself and also for the sealed structure, and may further decrease need for service and downtime.

According to an embodiment, the first seal element and the second seal element form a seal assembly, wherein the rigid second seal element is fastened to body of the breaking hammer only by means of the resilient first seal element.

According to an embodiment, the diameter of the first tool opening of the resilient first seal element is dimensioned to be slightly smaller than diameter of the tool, and the diameter of the second tool opening of the rigid second seal element is dimensioned to be slightly greater than the diameter of the tool. Thus, there may be a compression sealing between the first seal element and the tool, and a clearance sealing between the second seal element and the tool. In other words, the first seal element may have an initial squeeze against surface of the tool. The seal according to this embodiment is provided with two different sealing principles. The sealing of the first seal element is based on resilient material of the first seal element being urged or pressed against an outer surface of the tool, and the sealing of the rigid second seal element is based on accurate dimensioning of the second tool opening relative to the tool.

According to an embodiment, the diameter of the first tool opening of the resilient first seal element is dimensioned to be substantially the same as the diameter the tool. In other words, clearance between the first tool opening and the tool may be zero or close to zero.

The first seal element is still in resilient contact with the tool. The second seal element has a clearance sealing. Further, diameter of the second tool opening is dimensioned to be slightly greater than the diameter of the tool.

According to an embodiment, there is a small clearance between the diameter of the first tool opening of the resilient first seal element and the outer diameter of the tool.

According to an embodiment, the rigid second seal element has a clearance sealing. An inner diameter of the second tool opening may be 0.5 mm greater than an outer diameter of the tool when the diameter of the tool is 100-200 mm.

According to an embodiment, the body of the breaking hammer includes a protective casing and the first seal element is fastened to a bottom plate of the protective casing. The entire rigid second seal element is configured to be located outside the body.

According to an embodiment, the resilient first seal element is protected by the rigid second seal element. The first seal element includes a first end, which is intended to face towards the breaking hammer, and a second end, which is intended to face away from the breaking hammer. The second seal element has a cup-like configuration and is configured to cover the first seal element at the portion of the second end, whereby the rigid second seal element is configured to serve as a mechanical shielding element for the resilient first seal element. The first seal element is well protected since it is partly inside the second seal element and the rest of it is located inside the body structures. The rigid second seal element has double purpose since it provides not only sealing but also protection against external forces and hits.

According to an embodiment, the second end portion of the first seal element, which is facing towards the impact direction, is configured to protrude from the body of the breaking hammer and the rigid second seal element is configured to cover the protruding part of the first seal element. Thus, the first seal element is partly enveloped by the shielding second seal element.

According to an embodiment, the first seal element is made of soft material and the second seal element is made of hard material. Both seal elements need to be resistant against wear. The soft material of the first seal element may be an elastic material, which reshapes when subjected to external force. The hard material of the second seal element may be a substantially incompressible material.

According to an embodiment, the first seal element is made of at least one resilient synthetic plastic material.

According to an embodiment, the first seal element is made of a polyurethane material and the second seal element is made of a metallic material. The polyurethane is wear and tear durable resilient material and provides the element with proper sealing properties. The second seal element made of metal material endures external forces and hits well.

According to an embodiment, the seal is as disclosed in the previous embodiment except that as an alternative to the polyurethane, the resilient first seal element may be made of rubber, rubber compound material or resilient rubber-like material.

According to an embodiment, the first seal element is made of one or more resilient materials. The resilient material may be temporarily reshaped and may recover its initial shape after a deflecting force terminates. Since the first seal element provides support for the second seal element and allows the second seal element to move axially in the impact direction, the first seal element needs to be durable against tearing forces, i.e. the first seal element has good tear strength properties. The resilient tear tolerating first seal element serves as a good mounting platform for the second seal element.

According to an embodiment, the rigid second seal element is made of steel, or wear and abrasion resistant steel.

According to an embodiment, the fastening between the first seal element and the second seal element is connectable and disconnectable. The fastening between the seal elements is based on shape-locking, whereby no separate fastening members are needed. The fastening between the seal elements is disconnectable for allowing mounting and dismounting of the first seal element separately to and away from the body of the breaking hammer. This facilitates the seal mounting significantly.

According to an embodiment, the fastening of the first seal element to the body of the breaking hammer is based on shape locking, whereby the fastening of the seal requires no separate fastening means. A further advantage is that the mounting of the seal is facilitated and quickened.

According to an embodiment, the sealing housing includes an aperture through which the tool penetrates outside the body. Thereby, sealing housing may have relatively simple configuration. A simple aperture made to a wall structure may serve as the sealing housing.

According to an embodiment, the body of the breaking hammer includes a protective casing and the sealing housing is an aperture at a bottom plate of the protective casing.

According to an embodiment, the rigid second seal element has a floating mounting in a transverse direction of the tool. When the tool is moved during the operation transversally, the rigid second seal element surrounding the tool moves in the same direction together with the tool. The floating transverse mounting prevents seizing between the tool and the rigid second seal element. The floating mounting of the second seal element is based on elastic material of the first seal element. When the tool and the rigid second seal element move transversally the resilient first seal element reshapes without losing sealing properties. The shape of the first seal reverses to its initial shape when the tool and the second seal element move back to axial center line of the breaking hammer.

According to an embodiment, the rigid second seal element has the floating mounting also in the axial direction. The second seal element may move axially towards impact direction. The resilient material of the first seal element allows this movement. However, the material of the first seal element needs to have good tear strength properties to withstand this movement. The rigid second seal element may be supported axially to a bottom plate of a protective casing so that axial movement in a return direction is restricted. The axial floating feature also prevents seizing between the tool and the second seal element.

According to an embodiment, the breaking hammer includes a protective casing surrounding the percussion device and the disclosed seal is fastened to the protective casing. Then the protective casing is provided with a tool aperture through which the tool is arranged to pass. The tool aperture of the protective casing may serve as a seal housing inside which the first seal element is mounted. The tool aperture serving as the seal housing may be a simple hole in a bottom plate of the protective casing, or it may comprise suitably shaped surfaces for facilitating fastening of the first seal element.

According to an embodiment, the breaking hammer includes a protective casing and the rigid second seal is located outside the protective casing. Then the second seal element protrudes from a bottom plate of the protective casing. The second seal element may be the only part of the seal that is visible to outside of the breaking hammer. The rigid second seal element is intended to provide protection for the first seal element.

According to an embodiment, the first seal element is configured to protrude from the lower end of the protective casing and the second seal element is configured to cover the protruding portion of the first seal element. Thus, the first seal element is invisible to outer surface side of the protective casing and the second seal element serves as a shielding element for the first seal element. The second seal element may have a cup-like configuration so that it covers the first seal element effectively.

According to an embodiment, the rigid second seal element has a cup-shaped configuration and it includes a first end facing towards a bottom plate of the protective casing and a distal second end facing towards impact direction. The first end of the second seal element is supported axially against an outer surface of the bottom plate. The second seal element may move together with the tool slightly towards the impact direction since it is fastened to the resilient first seal element. However, movement of the second seal element towards the percussion device is prevented since the second seal element is supported axially against the bottom plate of the protective casing. The seal may be considered to have an axial mounting allowing floating towards the impact direction.

According to an embodiment, the rigid second seal element has a cup-like shape and an outer surface of the cup-shaped second seal element tapers from the first end towards the distal second end.

According to an embodiment, the breaking hammer includes a protective casing and the first seal element is fastened to the protective casing. Alternatively, the first seal element is fastened to a tool bushing which is located at a tool side end of the percussion device. The resilient first seal element may be arranged to envelope lower end portion of the tool bushing and fastening of the first seal element may be based on generated friction forces. A further alternative is that the first seal element is fastened to a lower end portion of the body of the percussion device.

According to an embodiment, the disclosed seal is not fastened to a protective casing, but is instead fastened to a frame of a percussion device of the breaking hammer. Thus, the sealing housing and the seal are located at tool side end of the frame of the percussion device. This embodiment may be utilized in solutions that are without any protective casing surrounding the percussion device.

According to an embodiment, the axial sealing contact length of the seal is dimensioned to be greater than axial movement of the tool during hammering operation. The tool is configured to be reciprocated by means of the percussion device, whereby the reciprocating tool has a maximum axial movement length. The first seal element has a first axial sealing contact length and the second seal element has a second axial sealing contact length. When total axial sealing contact length of the seal facing the tool is dimensioned to be greater than the maximum axial movement of the reciprocating tool, penetration of rock dust and other impurities along the tool surface inside the structure is effectively prevented. Due to the disclosed structure of the seal, it is easy to dimension the sealing contact length to be relatively long.

According to an embodiment, the sealing contact length of the first seal element alone is dimensioned to be greater than the maximum axial movement of the tool during the operation. Furthermore, in some cases, also the second seal element alone may be dimensioned to form sealing contact length that is greater than the operational axial movement of the tool. Both solutions provide effective protection against impurities.

According to an embodiment, the first seal element includes several transverse openings, which allow an outer form of the first seal element to be modified for the duration of mounting of the seal. Due to the transverse openings, the first sealing element may be mounted more easily and with minor force in place to the sealing housing. The number of the transverse openings may be two, three, four or even more.

According to an embodiment, the first seal element may have a symmetrical shape. This facilitates mounting, since the first element does not then have any predetermined mounting direction to be considered.

It should be appreciated that the sealing of the tool of the breaking hammer is also suitable for other types of breaking hammers than those disclosed herein and the percussion or impact device may differ from the one shown, for example.

The above-disclosed embodiments can be combined to form desired solutions provided with necessary features disclosed.

The foregoing summary, as well as the following detailed description of the embodiments, will be better understood when read in conjunction with the appended drawings. It should be understood that the embodiments depicted are not limited to the precise arrangements and instrumentalities shown.

BRIEF DESCRIPTION OF THE DRAWINGS

For the sake of clarity, the figures show some embodiments of the disclosed solution in a simplified manner. In the figures, like reference numerals identify like elements.

DETAILED DESCRIPTION

Figure 1:
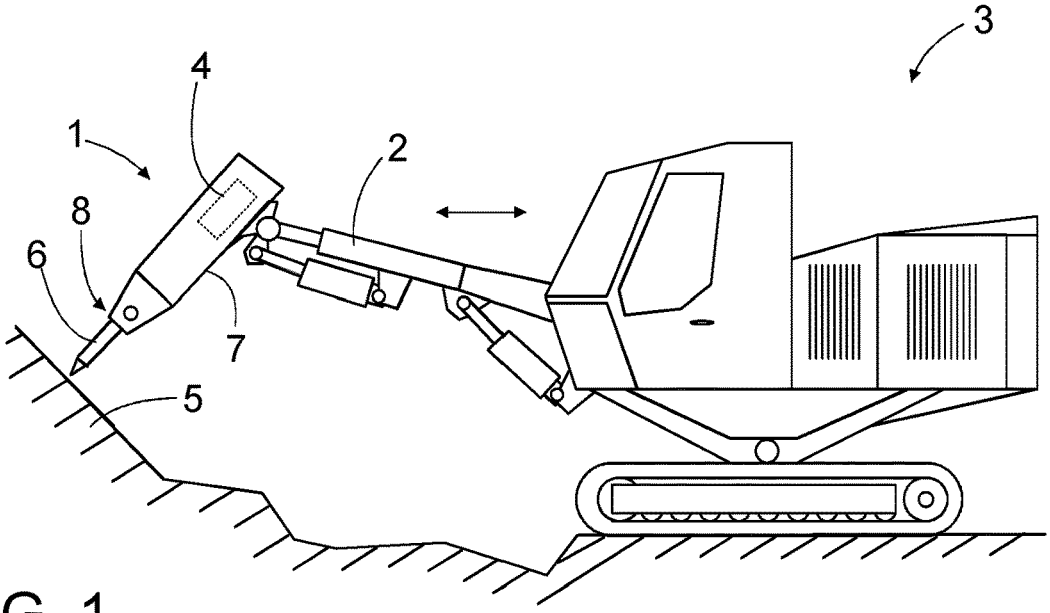
FIG. 1 is a schematic side view of an excavator, which is provided with a breaking hammer.

FIG. 1 shows a breaking hammer 1 arranged at a free end of a boom 2 in a working machine 3, such as an excavator. Alternatively, the boom 2 may be arranged on any movable carriage or on a fixed platform of a crushing apparatus. The breaking hammer 1 includes a percussion device 4 for generating impact pulses. The breaking hammer 1 may be pressed by means of the boom 2 against material 5 to be broken and impacts may be simultaneously generated with the percussion device 4 to a tool 6 connected to the breaking hammer 1. The tool 6 transmits the impact pulses to the material 5 to be broken.

The percussion device 4 may be hydraulic, whereby it may be connected to the hydraulic system of the working machine 2. Alternatively, the percussion device 4 may be electrically or pneumatically powered. The impact pulses may be generated in the percussion device 4 by means of a percussion element, such as percussion piston, that may be moved back and forth in the impact direction and return direction under the influence of hydraulic fluid. Further, the breaking hammer 1 may include a protective casing 7, inside which the percussion device 4 may be located.

At a lower end of the breaking hammer, i.e. at the tool side end, is a sealing arrangement 8 for sealing the tool 6 to the surrounding structures of the breaking hammer. The sealing arrangement 8 includes a seal disclosed herein.

Figure 2:
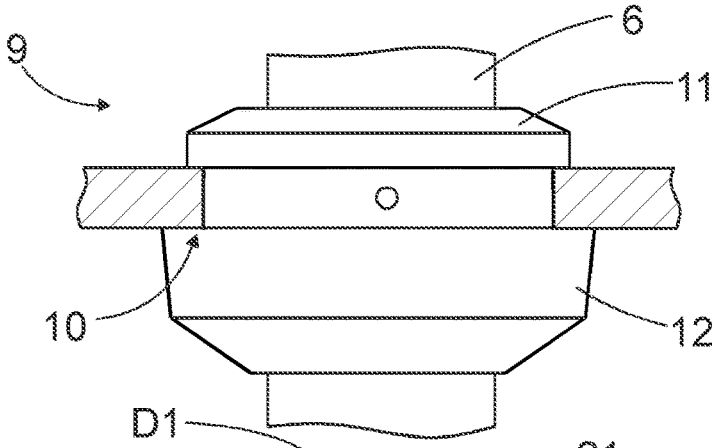
FIG. 2 is a schematic side view of a seal arrangement.

FIG. 2 illustrates a seal 9, which is arranged inside a sealing housing 10 and surrounds the tool 6 of the breaking hammer. A tool aperture formed in the protective casing or any other body element of the breaking hammer may serve as the sealing housing. Thus, the sealing housing may have a relatively simple configuration. The seal 9 has a two-part configuration having a first seal element 11 and a second seal element 12. The first seal element 11 is made of a resilient material and it has dual purpose, since it serves as a fastening platform for the second seal element 12 in addition to the sealing feature. The second seal element 12 is made of rigid material and it also has a dual purpose, since it provides mechanical protection for the first seal element 11 in addition to the sealing feature.

Figure 4:
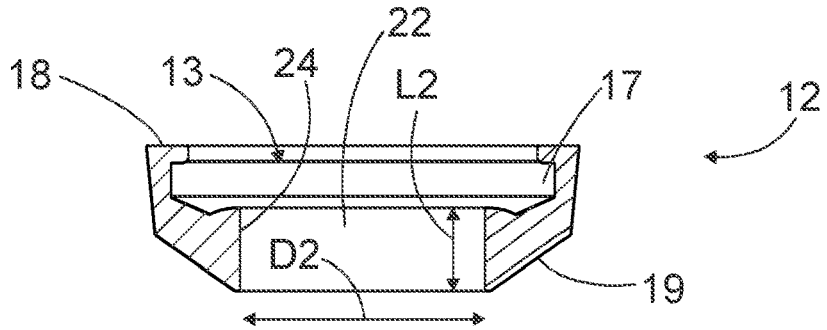
FIG. 4 is a schematic and sectional side view of a second seal element of the seal shown in FIG. 2.

As shown in FIG. 4, the second seal element 12 may be a cup-like sealing component and it may include a space 13 for receiving the lower part of the first seal element 11 therein. An outer surface of the first seal element 11 includes fastening means for fastening it to the sealing housing. The fastening means may comprise shoulders 15 and 16. The upper shoulder 15 may be supported against an axial support surface of the sealing housing 10 or structures surrounding the sealing housing. The lower shoulder 16 may be configured to be received by an annular connecting space 17, which is located at the upper part of the second seal element 12. The shoulder 16 and the connecting space 17 together form a shape locking means between the seal elements 11 and 12. As can be noted, the second seal element 12 is without any fastening surfaces for fastening it to the sealing housing 10. However, the second seal element 12 includes an upper axial support surface 18, which is supported against body surfaces surrounding the sealing aperture or housing 10. The axial support surface prevents the second seal element 12 from moving upwards, but on the other hand, allows movement downwards and sideward. Further, an outer surface of the second seal element may have one or more downward tapering portions 19.

The outer periphery of the first seal element 11 further includes an outer sealing surface 20, which is sealed against inner surfaces of the sealing housing 10. The upper shoulder 15 and the resilient material of the first seal element 11 provide the first seal element 11 with a tight sealing against the body. Since the second seal element 12 is intended to be mounted outside the body of the breaking hammer, it is without any sealing surfaces facing towards the body. The first seal element 11 includes a first tool opening 21 and the second seal element includes a second tool opening 22. The first seal opening 21 includes first sealing surfaces 23 that are in a resilient contacting relationship with an outer surface of the tool 6. The first sealing surfaces 23 have first axial sealing contact length L1. The second tool opening 22 includes second sealing surfaces 24 facing towards the tool 6 and forming a clearance sealing with the tool 6. The second sealing surfaces 24 have second axial sealing contact length L2. Total axial sealing contact length of the seal 9 may be relatively great, which ensures good sealing properties for the seal. Since the first seal element 11 has resilient contact sealing and the second seal element 12 has clearance sealing, the diameter D1 of the first tool opening 21 is smaller than the diameter D2 of the second tool opening 22.

Figure 3:
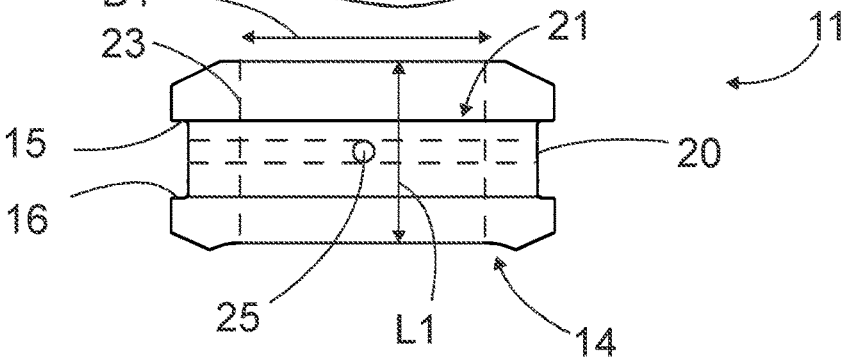
FIG. 3 is a schematic side view of a first seal element of the seal shown in FIG. 2.

FIGS. 2 and 3 further disclose that the first seal element 11 may have one or more transverse through openings 25, the purpose of which are to make the first seal element more bendable and to thereby facilitate mounting of the first seal element 11 to the sealing housing 10. In other words, shaping of the first seal element 11 during mounting is facilitated by openings 25.

Figure 5:
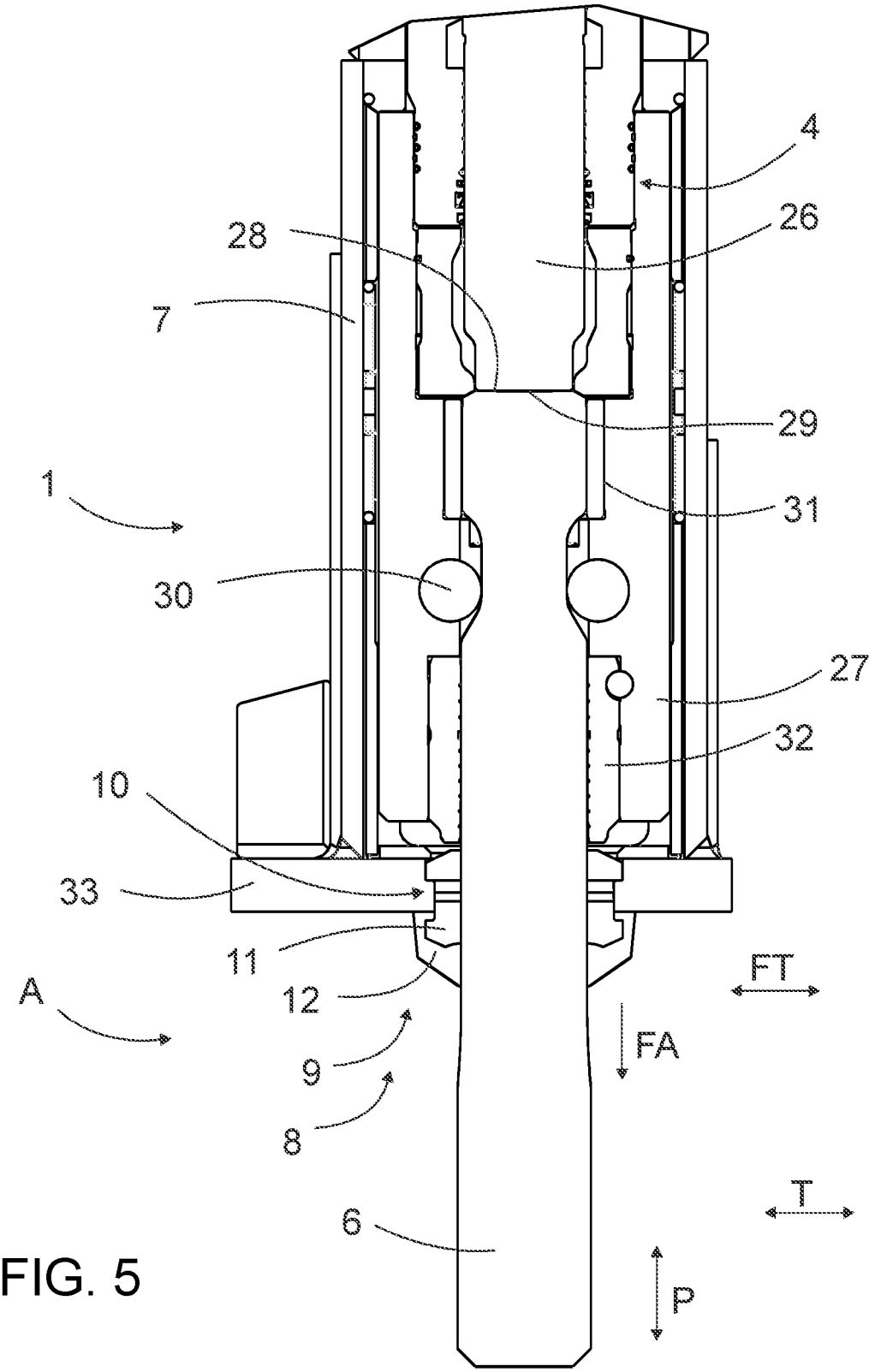
FIG. 5 is a schematic and sectional side view of a lower end portion of a breaking hammer provided with a two-part tool seal.

FIG. 5 discloses part of a structure of a breaking hammer 1. The breaking hammer 1 includes a lower end A at a tool side end. An upper end, which is not shown in FIG. 5, is provided with mounting means for connecting the breaking hammer 1 to a boom. Inside a protective casing 7 is a percussion device 4, which may include a percussion piston 26 arranged to reciprocate relative to a frame 27 of the percussion device 4. An impact surface 28 of the percussion piston 26 is arranged to strike an upper end 29 of a tool 6.

The tool 6 may be connected to the breaking hammer 1 by means of transverse connecting pins 30. The tool 6 is allowed to move in the axial direction P during use. The tool 6 is supported to the frame of the percussion device 4 by means of an upper tool bushing 31 and a lower tool bushing 32. At the lower end of the breaking hammer 1 is a sealing arrangement 8 including a seal 9 through which the tool 6 passes. The seal 9 is arranged in a sealing housing 10, which surrounds the tool 6. The sealing housing 10 may be formed to be part of a bottom plate 33 of the protective casing 7. As discussed already above, the sealing housing 10 may alternatively be part of the frame 27 of the percussion device 4 if no protective casing 7 exists. Furthermore, it is possible to provide shape locking between the seal 9 and the lower tool bushing 32.

During use of the breaking hammer 1, the tool 6 is subjected to forces in a transverse direction T in addition to operational forces directed in the axial direction P. These transverse forces make the tool 6 move in the transverse direction T. The seal 9 needs to withstand this transverse movement and to keep the sealing tight. In the present solution, the rigid second seal element 12 may move together with the tool 6 in the transverse direction T since fastening of the second seal element 12 has a transverse floating feature FT. Since the second seal element 12 follows continuously the tool 6, it will also provide continuous sealing for the tool 6. In case the rigid second seal element 12 gets stuck to the tool 6 in special circumstances, the second seal element 12 may move a limited distance together with tool in the impact direction. Thus, the second seal element 12 may also have an axial floating feature FA. The floating features FT and FA of the second seal element 12 are enabled by the elastic material of the first seal element 11 and because the second seal element 12 is not directly fastened to the sealing housing 10 or body structure of the breaking hammer 1.

When positioning the seal 9 in the sealing housing 10, the tool 6 is first removed and thereafter the first seal element 11 may be pressed into a smaller outer dimension in order to allow it to be pushed inside the sealing housing 10. When the shaping force is released, the first seal element will automatically press against surfaces of the sealing housing 10. Thereafter, the second seal element 12 is mounted on a protruding portion of the first seal element 11 and is fastened by the shape locking means to the first seal element 11. Finally, the tool 6 is pushed through the seal elements 11 and 12 into its designed place and is locked by means of one or more locking pins. Thus, in the disclosed solution only the tool 6 needs to be dismounted when the seal 9 is changed. The two-part seal 9 prevents effectively impurities from entering inside the structure of the breaking hammer 1. An alternative to the previously described mounting principle is that the two part seal 9 is pre-assembled and is mounted in one piece. The tool 6 locks the seal 9 in place.

Figure 6:
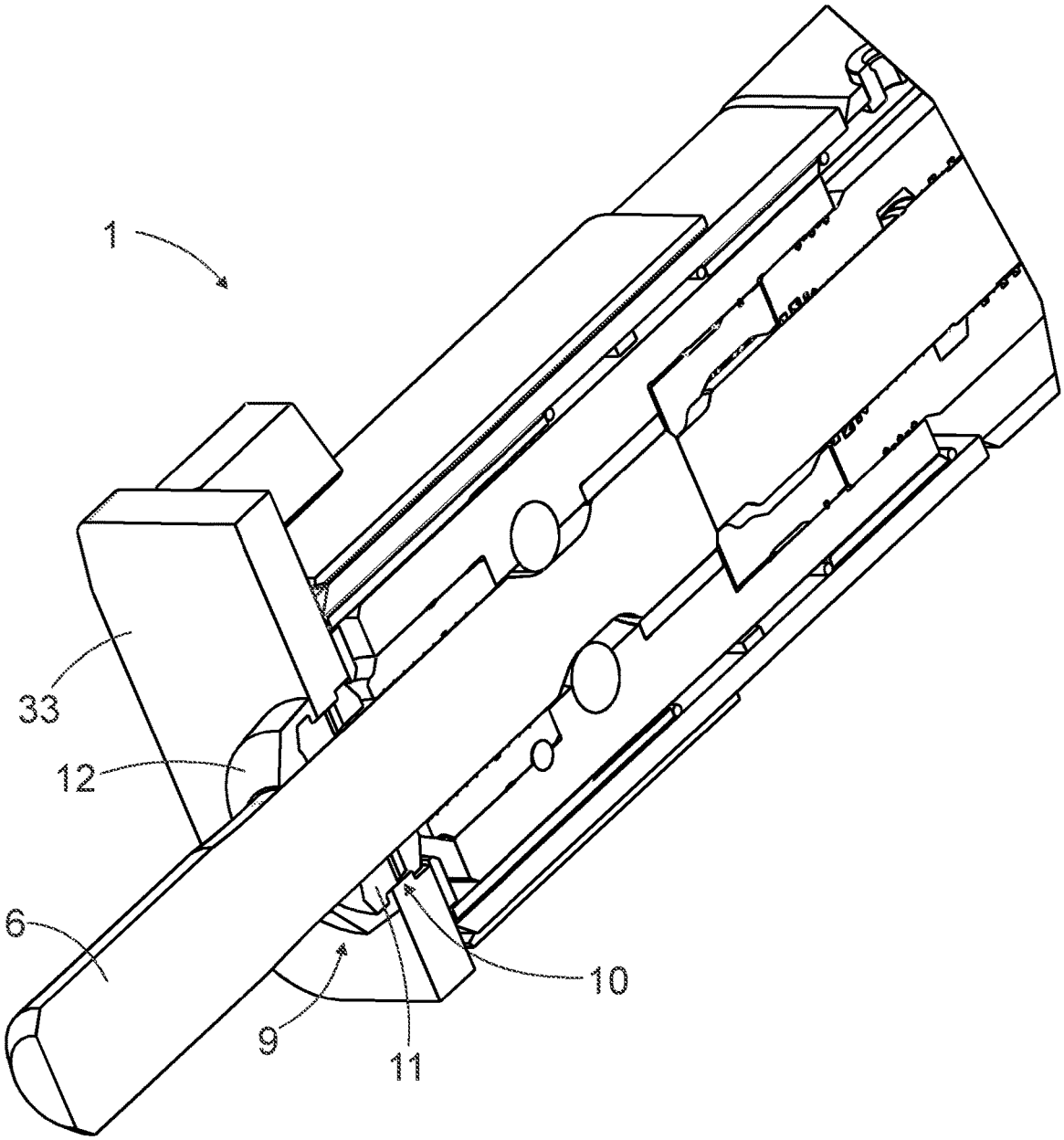
FIG. 6 is a schematic and sectional descriptive view of a tool side end portion of a breaking hammer.
Figure 7:
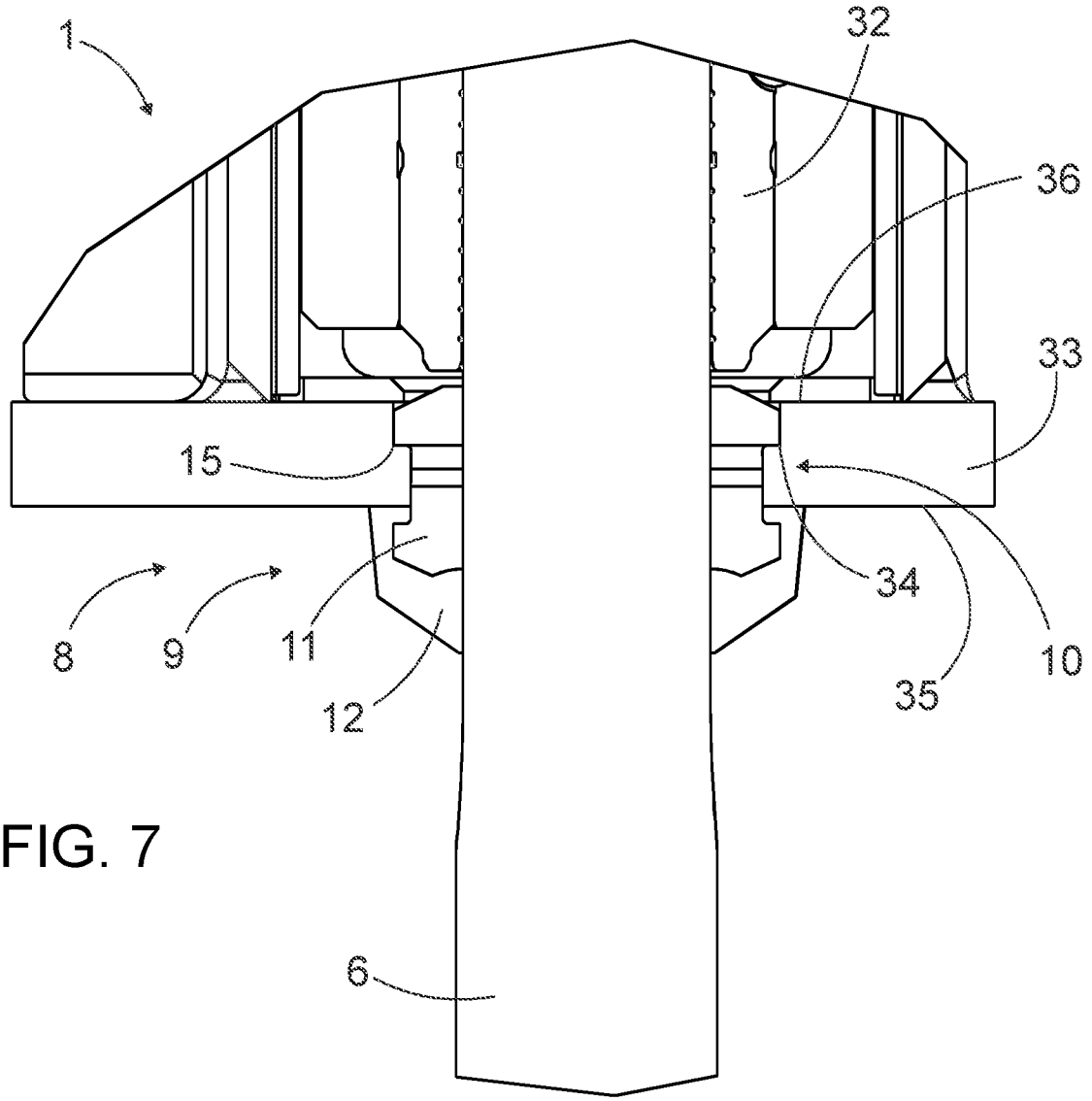
FIG. 7 is a schematic and sectional side view showing sealing arrangement of a tool of a breaking hammer.

FIG. 6 shows the lower part of the breaking hammer of FIG. 5 in another view angle. FIG. 7 shows the previously disclosed lower part of the breaking hammer 1 and the seal arrangement 8 in a more detailed manner.

The sealing housing 10 may include a shoulder 34 against which the upper support surface 15 of the first seal element 11 may be supported. Thus, the mounting of the first seal element 11 may be easier when distance between the upper support surface 15 and an outer surface 35 of the bottom plate 33 is smaller than the total thickness of the bottom plate 33. Further, the thickness of the bottom plate 33 may be dimensioned according to the need without influencing to the mounting of the seal 9.

As an alternative to the previously disclosed solution, the upper support surface 15 of the first seal element 11 may be supported against an inner surface 36 of the bottom plate 33. A further alternative is to provide a lower end portion of the lower tool bushing 32 with fastening surfaces for receiving shape locking surfaces of the first seal element 11.

Figure 8:
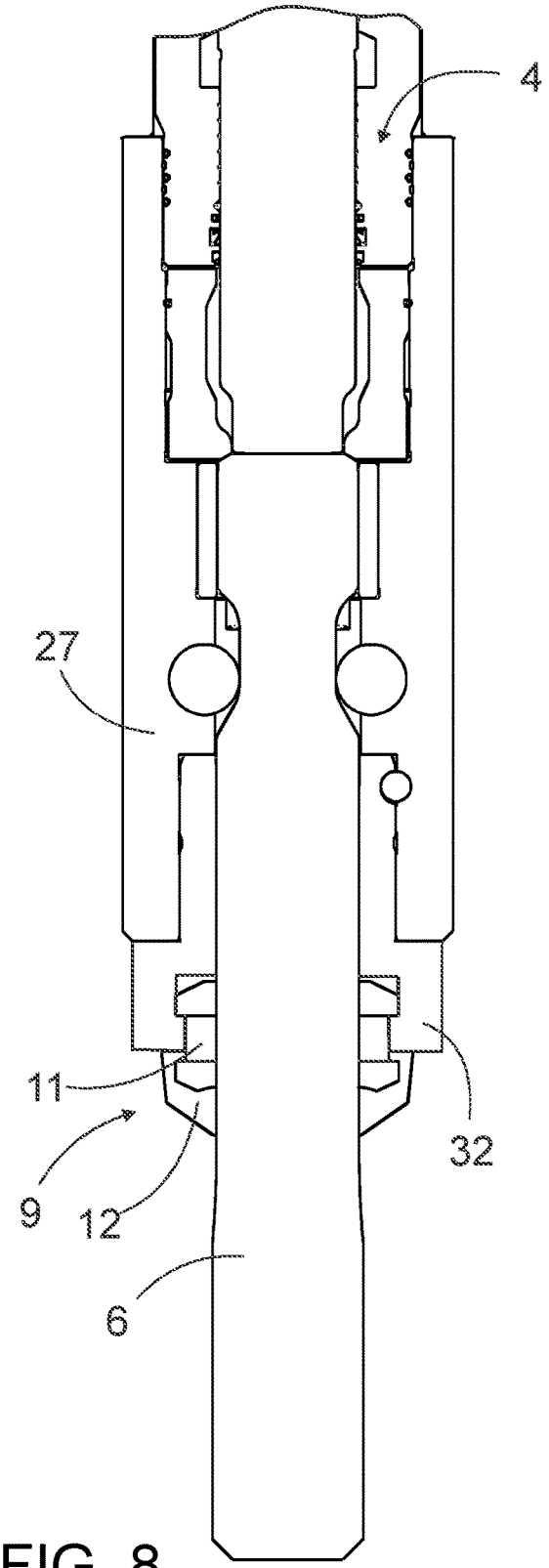
FIGS. 8-11 are schematic views of some alternative structures and mounting principles of the seal.
Figure 9:
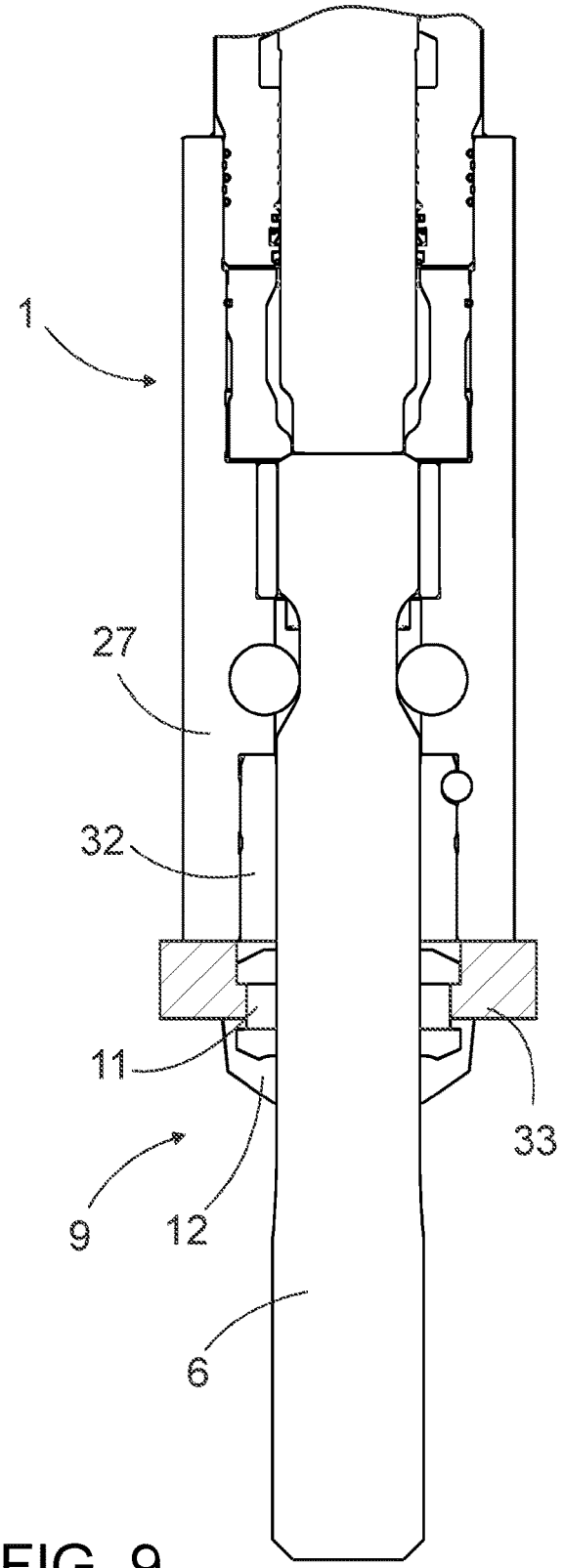

FIGS. 8 and 9 disclose alternative solutions wherein the breaking hammer 1 is without the protective casing and the seal 9 is fastened to a lower end portion of the frame 27 of the percussion device 4. In FIG. 8, the first seal element 11 is fastened to the lower tool bushing 32 and in FIG. 9 the first seal element 11 is fastened to the bottom plate 33 of the percussion device 4.

Figure 10:
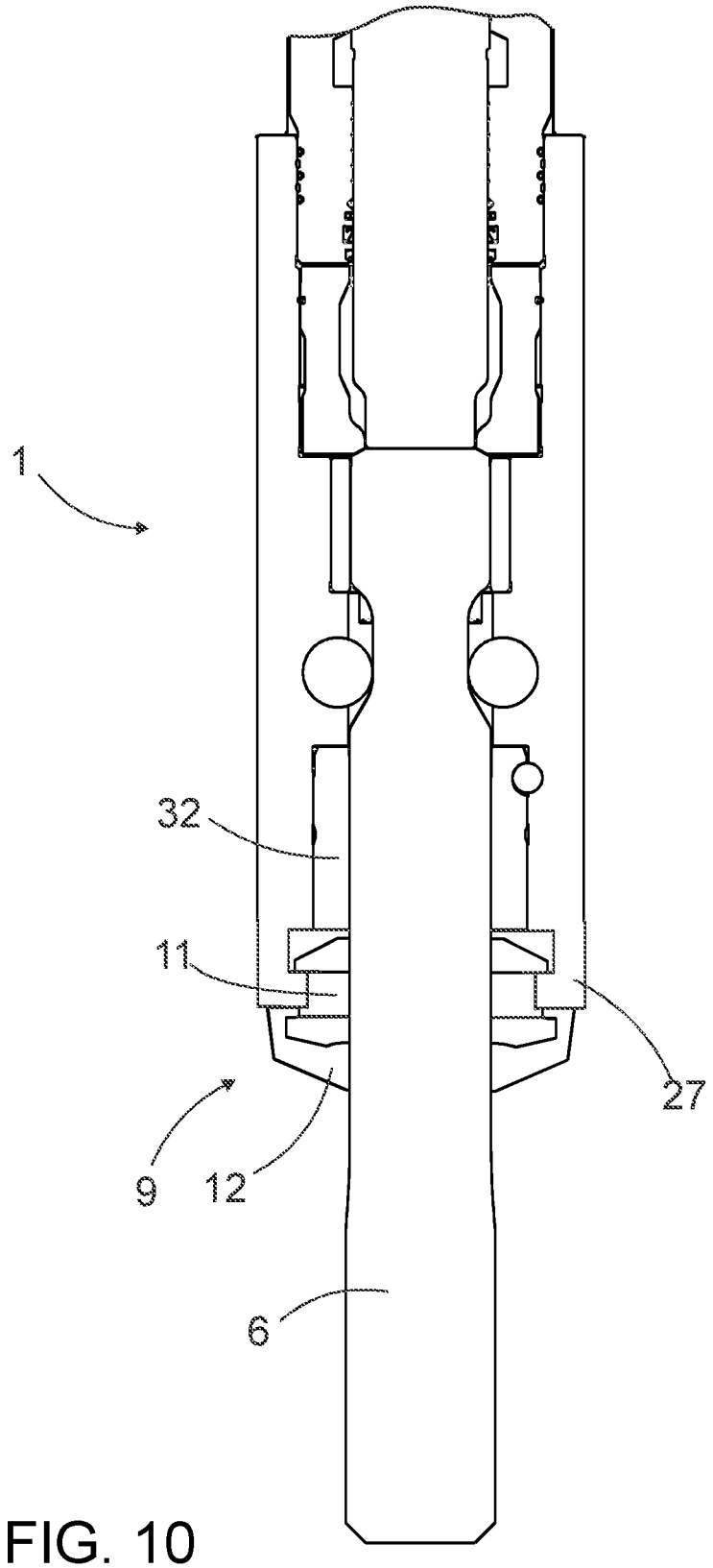
Figure 11:
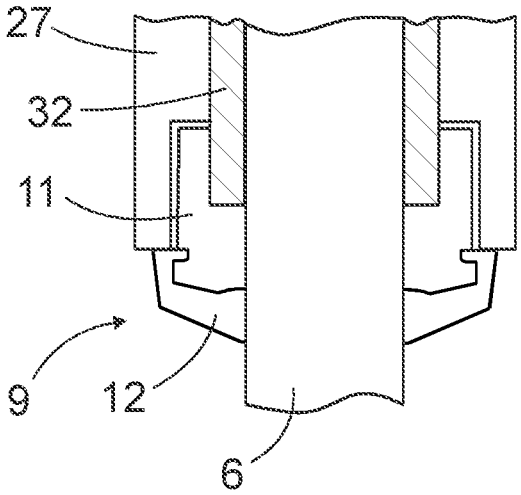

As shown in FIG. 10 the seal 9 is fastened directly to the lower end portion of the frame 27 of the percussion device 4. Further, FIG. 11 illustrates that the first sealing element 11 of the seal 9 may envelope the lower end portion of the lower tool bushing 32. An inner diameter at the upper portion of the first seal element may be dimensioned so that a suitable compression and friction forces are generated when it is mounted on the lower end portion of the tool bushing 32.

Although the present embodiment(s) has been described in relation to particular aspects thereof, many other variations and modifications and other uses will become apparent to those skilled in the art. It is preferred therefore, that the present embodiment(s) be limited not by the specific disclosure herein, but only by the appended claims.

What is claimed is:

1. A sealing arrangement comprising:

a tool associated with a breaking hammer;

a sealing housing defined by an inner surface located around the tool;

an annular gap formed between an outer surface of the tool and an inner surface of the sealing housing; and a sleeve-like seal arranged to seal the annular gap, the seal having an inner periphery, an outer periphery and an axial length, the inner periphery of the seal including first and second tool openings each provided with sealing surfaces arranged to face towards the tool to be sealed, and the outer periphery of the seal being provided with fastening surfaces for fastening the seal to a body of the breaking hammer, wherein the seal includes a first and a second seal element, the first seal element having a first end arranged to face towards the breaking hammer and a second end arranged to face away from the breaking hammer, the first seal element being made of a resilient material and including the first tool opening arranged to be in a resilient contacting relationship with the tool, wherein the fastening surfaces are located on the outer periphery of the first seal element, the first and second seal elements being arranged successively in an axial direction, the second seal element being fastened only to the first seal element, such that the second seal element is without fastening surfaces for fastening it to the body of the breaking hammer, and wherein the second seal element is a rigid element and includes the second tool opening, which is dimensioned to form a sealing clearance between the tool and the second seal element, the second seal element having a cup-like configuration and being configured to cover the first seal element at the portion of the second end, wherein the rigid second seal element is configured to serve as a mechanical shielding element for the resilient first seal element, the fastening between the first seal element and the second seal element being connectable and disconnectable, such that the fastening is based on shape-locking, the resilient first seal element of the seal allowing the rigid second seal element to move transversally together with the tool relative to the sealing housing, wherein the body of the breaking hammer includes a protective casing and the first seal element is fastened to a bottom plate of the protective casing and the entire rigid second seal element is configured to be located outside the body and the first seal element is protected by the rigid second seal element.

2. The seal arrangement as claimed in claim 1, wherein the first seal element is made of a polyurethane material.

3. The seal arrangement as claimed in claim 1, wherein the second seal element is made of a metallic material.

4. A breaking hammer comprising:

a percussion device;

a tool connectable to the percussion device;

a sealing housing located around the tool; and a seal arrangement in accordance with claim 1.

5. The breaking hammer as disclosed in claim 4, wherein the breaking hammer includes a protective casing surrounding the percussion device, the protective casing being provided with a tool aperture through which the tool is arranged to pass.

6. The breaking hammer as disclosed in claim 5, wherein the sealing housing and the seal are located at the tool aperture of the protective casing.

7. The breaking hammer as disclosed in claim 4, wherein the percussion device includes a frame, the sealing housing and the seal being located at a tool side end of the frame.

8. The breaking hammer as claimed in claim 4, wherein the tool is configured to be reciprocated by the percussion device, wherein the reciprocating tool has a maximum axial movement length, and wherein the first seal element has a first axial sealing contact length and the second seal element has a second axial sealing contact length, a total axial sealing contact length of the seal facing the tool being dimensioned to be greater than the maximum axial movement of the reciprocating tool.

9. A method of sealing a tool of a breaking hammer, the method comprising:

providing the breaking hammer with at least one seal, the seal including a first seal element made of resilient material and a second seal element made of rigid material, the breaking hammer including a body having a protective casing;

arranging the seal in a sealing housing of the breaking hammer;

passing the tool through first and second tool openings of the seal;

fastening the seal to the sealing housing by means of fastening surfaces of the first seal element;

fastening the second seal element only to the resilient first seal element and allowing the rigid second seal element to move transversally together with the tool relative to the sealing housing, wherein the first seal element is fastened to a bottom plate of the protective casing and the entire rigid second seal element is configured to be located outside the body and the first seal element is protected by the rigid second seal element;

generating a first sealing function by arranging the resilient material of the first seal element against an outer surface of the tool; and generating a second sealing function by means of a sealing clearance dimensioned between the tool and the rigid second seal element.

10. The method according to claim 9, further comprising shielding, by means of the rigid second seal element, portions of the first seal element that are visible to outside of the breaking hammer, wherein the second seal element serves as a combined sealing and shielding component.

* * * * *